US007481687B2

(12) United States Patent
Lewis

(10) Patent No.: US 7,481,687 B2
(45) Date of Patent: Jan. 27, 2009

(54) JET PROPULSION OUTBOARD AND INBOARD MOTOR

(76) Inventor: Brad J. Lewis, 2517 NW. 3rd Ave., Fort Lauderdale, FL (US) 33311

( * ) Notice: Subject to any disclaimer, the term of this patent is extended or adjusted under 35 U.S.C. 154(b) by 0 days.

(21) Appl. No.: 11/807,658

(22) Filed: May 30, 2007

(65) Prior Publication Data

US 2008/0299845 A1 Dec. 4, 2008

(51) Int. Cl.
*B63H 1/26* (2006.01)
*B63H 11/00* (2006.01)

(52) U.S. Cl. ..... 440/48; 440/38

(58) Field of Classification Search ..... 440/38
See application file for complete search history.

(56) References Cited

U.S. PATENT DOCUMENTS 1,886,191 A * 11/1932 Johnson ..... 440/53
2,656,809 A * 10/1953 Frasure ..... 114/151
3,482,402 A * 12/1969 Anthoney, Sr. ..... 60/221
5,181,868 A * 1/1993 Gabriel ..... 440/38
5,215,486 A * 6/1993 Rizikow ..... 440/79
6,431,926 B1 * 8/2002 Rosefsky ..... 440/48
6,957,730 B1 10/2005 Youngwerth
7,000,751 B2 2/2006 AbuSamra et al.
7,147,093 B2 12/2006 Weidinger et al.

* cited by examiner

*Primary Examiner*—Jesus D Sotelo
(74) *Attorney, Agent, or Firm*—David J. Wilson

(57) ABSTRACT

The present invention relates to a novel and non-obvious propulsion system for watercraft, especially, but not limited to, watercraft less than about 50 feet in length. Propulsion system of the present invention provides a system that is less prone to being impeded by debris, water plants and the like; less likely to cause motor stalling or motor over heating if said propulsion system does become clogged or impeded and is designed to provide increased thrust resulting in, for example, more efficient operation.

20 Claims, 6 Drawing Sheets

JET PROPULSION OUTBOARD AND INBOARD MOTOR

BACKGROUND OF INVENTION

Water craft, especially small water craft designed for personal or small scale use, are typically driven by either a manual propulsion means (e.g., oars and paddles), one or more sails, a propeller or jet system coupled to a power source or an air-drive system resembling a large fan mounted on the back of the boat (i.e., an air boat).

The different drive systems are typically used for different purposes or are suitable for different types of waterways. For example, the operator of a canoe or a small rowboat may choose to use paddles or oars for exercise, because they are quite or because they are inexpensive and require little or no maintenance. Boats that are wind powered (i.e., sailboats) require skill to operate and are at the mercy of the wind.

Airboats are specially designed boats that are used most often in waterways which contain a large amount of under water plant growth and/or are shallow or have shallow areas. Airboats are ideal for this because they have no moving parts below the water that may get tangled on the under water plants or hit bottom in shallow areas. However, airboats are noisy since the propulsion means is a large fan mounted on the back of the boat. Also, the fan propulsion system takes up a considerable amount of space on the boat thereby limiting its use as a vehicle to transport persons or cargo.

The operator of a canoe and, especially, a rowboat may choose to use an outboard motor. Some of the advantages of using a motor are that the operator may travel at a greater speed and expend less energy than when using oars or paddles. Also, they are not at the mercy of the wind for propulsion. However, outboard motors suffer from the problem of getting tangled up in water plants or other debris that may be in the water. Often times boat operators must stop and untangle the propeller on the boat before they can continue. Prior art designs that tried to solve the problem of getting tangled also resulted in a reduction in power or thrust for a similar sized motor.

What is needed is a propulsion system for boats that can be used by the typical small boat operator that is more dependable that wind power, requires less energy that manual propulsion means and is designed 1) to resist being tangled by under water plants and other water hazards, 2) not cause motor stalling or other motor problems in the event that the drive means is impeded and 3) create adequate thrust for satisfactory propulsion of the water vehicle.

SUMMARY OF INVENTION

In one aspect, the invention relates to a novel and non-obvious propulsion system for watercraft, especially, but not limited to, watercraft less than about 50 feet in length. The goals of the propulsion system of the present invention are to provide, in one embodiment, a system that is less prone to being impeded by debris, water plants and the like; less likely to cause motor stalling or motor over heating if said propulsion system does become clogged or impeded and is designed to provide increased thrust resulting in, for example, more efficient operation.

In one embodiment, the propulsion system of the present invention is designed to be used as the drive portion of an outboard motor. In this regard, the propulsion system of the present invention would be, for example, replace the traditional propeller used on an outboard motor. In other words, the propulsion system of the present invention is not limited by the power source. For example, the power source may be an internal combustion engine or an electric motor. Examples of internal combustion engines and electric motors for the purpose of, for example, mounting on or in a small watercraft are well known in the art.

The power from the power source is transferred to the propulsion system of the present invention by, for example, a drive shaft, a belt or a chain. Although the present invention is not limited by the method used to transfer power from the power source to the propulsion system of the present invention, the preferred method is by the use of a drive shaft. This is because drive shafts are less prone to breakage and stretching like a belt drive system and less prone to breakage and seldom need oiling like a chain driven system.

The drive system of the present invention comprises, in one embodiment, a slip clutch. A slip clutch (or clutch, e.g., a centrifugal clutch or torque limiter) is a device designed to disengage if the resistance on the drive shaft or drive system exceeds a certain preset limit. For example, if the propulsion system (i.e., the impeller) of the present invention were to jam, the slip clutch of the present invention would disengage the drive system from the motor and allow the motor to keep turning thereby preventing the motor from stalling or over heating. In one embodiment, the slip clutch of the present invention comprises friction disks. When the resistance reaches the preset limit, the slip clutch may disengage by, for example, centrifugal force. The increase or decrease in centrifugal force (depending on if the system was designed to engage with an increase or decrease in centrifugal force) would cause the friction disc associated with either the motor or the impeller to release for the other friction disc. Such slip clutches are known in the art (see, for example, U.S. Pat. Nos. 7,147,093 to Weidinger, 7,000,751 to AbuSamra and 6,975,730 to Youngwerth and associated lineages and references cited therein, all of which are incorporated herein by reference).

The present invention is not limited to any particular preset limit at which the slip clutch of the present invention would disengage. In one embodiment, if the speed of the impeller were impeded such that the rotational speed of the portion of the drive shaft proximal to the impeller were decreased to one half the speed of the drive shaft proximal to the power source, the slip clutch would disengage. In another embodiment, if the speed of the impeller were impeded such that the rotational speed of the portion of the drive shaft proximal to the impeller were decreased to one quarter the speed of the drive shaft proximal to the power source, the slip clutch would disengage. In yet another embodiment, if the speed of the impeller were impeded such that the rotational speed of the portion of the drive shaft proximal to the impeller were decreased to one eight the speed of the drive shaft proximal to the power source, the slip clutch would disengage.

The propulsion system of the present invention replaces the traditional propeller of the outboard (or inboard) motor with a unique impeller system. The impeller of the present invention comprises, in one embodiment, a housing comprising an interior space for receiving an impeller, said impeller comprising a tubular body and two or more groups of blades, each group of blades comprising a plurality of blades extending from the inside of said tubular body towards the center of said tubular body without meeting at the center of said tubular body and angled to push water from the inlet to the outlet of the impeller housing when said impeller is powered to rotate.

In another embodiment, the linear spacing of the blades along the axis of the impeller body being progressively closer each other as the blades approach the impeller outlet and the circumferential location of said blades staggered such that their locations within said impeller body, when viewed in toto, approximate a spiral comprising a plurality of individual blades, said spiral getting progressively tighter towards the outlet.

Although the present invention is not limited by any theory, it is believed that this design allows for an increase in thrust over a design comprising equally spaced impeller blades since the flow of water will be increased as it passes through the impeller due to the progressively narrowing flow channel.

The present invention is not limited to the distance between any two blades so long as an adequate thrust is generated to propel a watercraft. The present invention is also not limited to the amount of decrease between any two blades as the blades approach the outlet of the impeller housing. In one embodiment, the linear distance between any two adjacent blades may decrease by about 0.1% to 25% of the distance between the blades with each complete (i.e., 360 degree) spiral of the blades as the blades progress from the inlet of the impeller housing to the outlet of the impeller housing. In another embodiment, the distance may decrease about 0.1% to 20%; in yet another embodiment, the distance may decrease about 0.2% to 15%; in yet still another embodiment, the distance may increase from 0.2% to 10% and in yet stall another embodiment, the distance may be between 0.3% and 5%.

In another embodiment, the impeller of the present invention comprises an impeller housing having an interior space for receiving an impeller, said impeller comprising a tubular body having an inlet and an outlet, a spiral blade extending from approximately the inlet to approximately the outlet of the tubular body wherein the distance between adjourning turns of the blade of the spiral are progressively closer to each other thereby creating a tighter spiral (i.e., the angle (or spiral) of said spiral is progressively tighter) as the blade progresses from the inlet to the outlet thus resulting in a narrower passage for water. Although the present invention is not limited to any particular theory, it is believed that a greater thrust is generated by the system as the water passes through the narrower channel thereby achieving greater speed.

The present invention is not limited to the distance between any two blades so long as an adequate thrust is generated to propel a watercraft. The present invention is also not limited to the amount of decrease between any two blades as the blades approach the outlet of the impeller housing. In one embodiment, the linear distance between any two adjacent blades may decrease by about 0.1% to 25% with each 360 degree spiral of the blade as the blades progress from the inlet of the impeller housing to the outlet of the impeller housing. In another embodiment, the distance may decrease about 0.1% to 20%; in yet another embodiment, the distance may decrease about 0.2% to 15%; in yet still another embodiment, the distance may increase from 0.2% to 10% and in yet stall another embodiment, the distance may be between 0.3% and 5%.

The propulsion system of the present invention also has other features and advantages. For example, the impeller housing of the present invention is mounted on sealed bearings such that water can not enter the motor housing from the impeller body. The advantage to this is that excess water is not retained by the propulsion system of the present invention. Any retained water would add weight to the system and slow down the watercraft. In the present invention, the term "sealed bearings" refers to, for example, bearings sealed to negate the necessity of oiling or greasing the bearing on a regular basis and may also mean that the bearings and/or bearing housings are constructed to include a seal that prevents water or other liquids from passing through or around the bearings or bearing housings. In one embodiment, the bearings and associate bearing housing comprises a seal to prevent liquids from passing through or around the bearings. In another embodiment, the seal is integral with the bearings and bearing housing and in another embodiment the seal is independent of the bearings and bearing housing.

In one embodiment, the present invention contemplates a propulsion system for a small water craft, comprising: a housing having an interior space for receiving an impeller, said impeller comprising a tubular body and two or more groups of blades, each group of blades comprising a plurality of blades extending from the inside of said tubular body towards the center of said tubular body without meeting at the center of said tubular body and angled to push water from the inlet to the outlet of the impeller housing when said impeller is powered to rotate; the linear spacing of said blades along the axis of said impeller body being progressively closer each other as the blades approach the impeller outlet and the circumferential location of said blades staggered such that their locations within said impeller body, when viewed in toto, approximate a spiral comprising a plurality of individual blades, said spiral getting progressively tighter towards the outlet; said impeller body supported on sealed bearings thereby allowing the impeller to rotate in said housing while preventing water from entering said housing; said impeller powered by a ring gear, said ring gear attached to the exterior of said impeller body; said ring gear driven by a drive shaft, said drive shaft comprising first and second ends, said first end comprising a bevel or spiral bevel gear that intermeshes with said ring gear and said second end comprising a slip clutch, wherein said slip clutch is connected to a power source when said power source is turned on and the rotation of said impeller is not impeded and is not connected to said power source when the rotation of said impeller is impeded.

In another embodiment of the present invention, the distance between spirals decreases by about 0.1-0.5% with every turn or the distance between spirals decreases by about 0.5-3.0% with every turn.

In another embodiment of the present invention, the slip clutch is designed to slip at about 10 pounds of torque or greater or at about 20-30 pounds of torque or greater.

In another embodiment of the present invention, the impeller is made of one or more of metal, plastic, hardened rubber, graphite or carbon fiber or a composite thereof.

In another embodiment of the present invention, the drive shaft(s) additionally comprise reduction gearing or step-up gearing.

In another embodiment of the present invention, the system comprises two impeller housings, each impeller housing having an impeller, both impellers driven by the same drive shaft. In another embodiment of the present invention, the system comprises two impeller housings, each impeller housing having an impeller, both impellers driven by different secondary drive shafts, each secondary drive shaft powered by the same power source through a primary drive shaft. In yet another embodiment of the present invention, each impeller and drive shaft combination has a separate slip clutch.

A propulsion system for a small water craft, comprising: an impeller housing having an interior space for receiving an impeller, said impeller comprising a tubular body having an inlet and an outlet, a spiral blade extending from approximately the inlet to approximately the outlet of the tubular body wherein the distance between adjourning turns of the blade of the spiral are progressively closer to each other thereby creating a tighter spiral as the blade progresses from said inlet to said outlet thus resulting in a narrower passage for water; said impeller body supported on sealed bearings thereby allowing the impeller to rotate in said housing while preventing water from entering said housing; said impeller powered by a ring gear, said ring gear attached to the exterior of said impeller body; said ring gear driven by a drive shaft, said drive shaft comprising first and second ends, said first end comprising a bevel or spiral bevel gear that intermeshes with said ring gear and said second end comprising a slip clutch, wherein said slip clutch is connected to a power source when said power source is turned on and the rotation of said impeller is not impeded and is not connected to said power source when the power source is turned on and the rotation of said impeller is impeded.

In another embodiment of the present invention, the distance between spirals decreases by about 0.1-0.5% with every turn or the distance between spirals decreases by about 0.5-3.0% with every turn.

In another embodiment of the present invention, the slip clutch is designed to slip at about 10 pounds of torque or greater or at about 20-30 pounds of torque or greater.

In another embodiment of the present invention, the impeller is made of one or more of metal, plastic, hardened rubber, graphite or carbon fiber or a composite thereof.

In another embodiment of the present invention, the drive shaft(s) additionally comprise reduction gearing or step-up gearing.

Although the propulsion system is not limited to the specific embodiments given here as one practiced in the art will know that minor changes can be made within the teachings of this paper and the certain preferred embodiments are given here. Other features and advantages of the invention will be apparent from the following drawings and description.

DETAILED DESCRIPTION OF PREFERRED EMBODIMENTS

Figure 1:
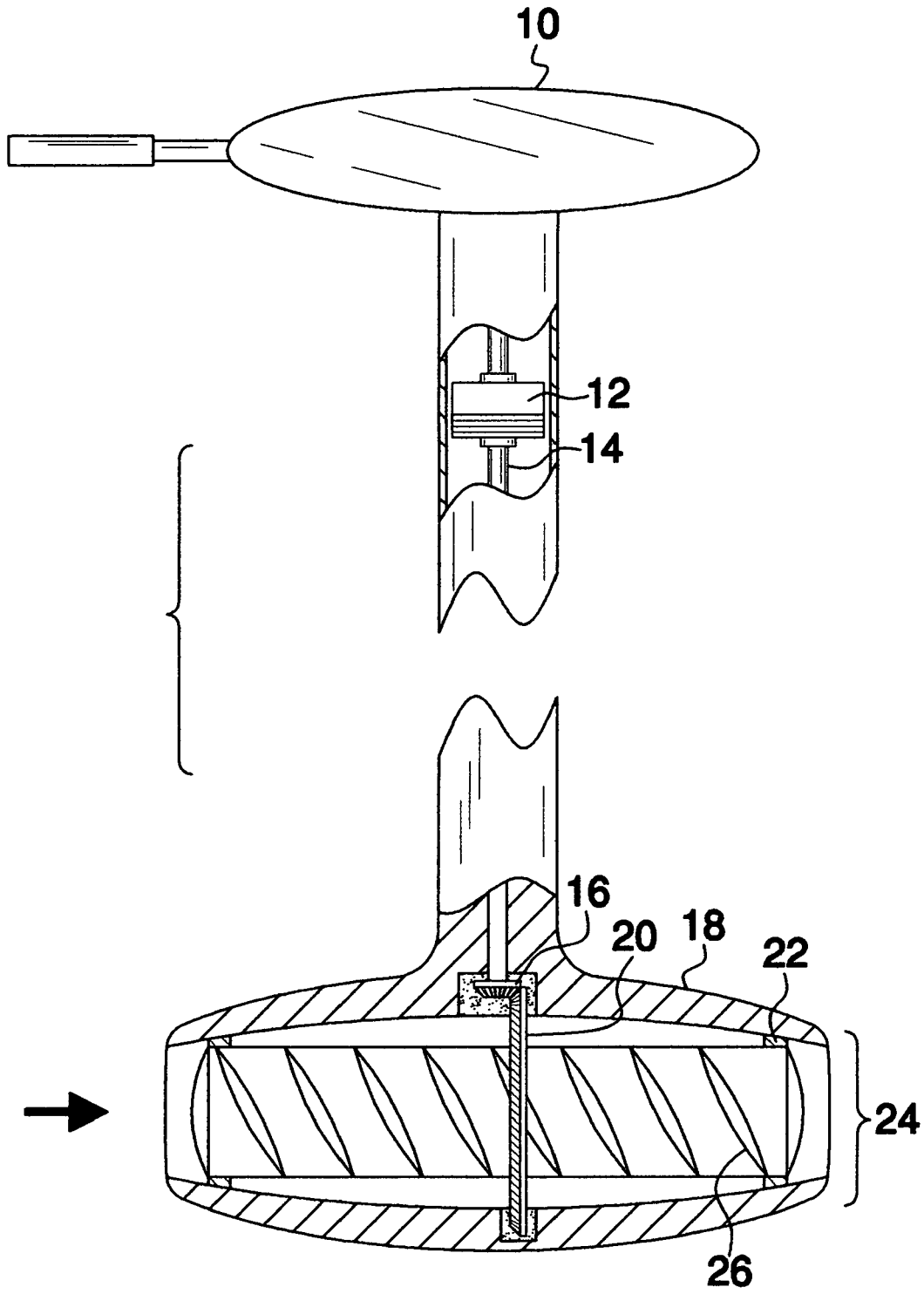
FIG. 1 shows one embodiment of the propulsion system for watercraft of the present invention.

The invention will now be described in detail with reference to a few preferred embodiments, as illustrated in accompanying drawings. In the following description, numerous specific details are set forth in order to provide a thorough understanding of the invention. However, it will be apparent to one skilled in the art that the invention may be practiced without some or all of these specific details. In other instances, well-known features and/or process steps have not been described in detail in order to not unnecessarily obscure the invention. The features and advantages of the invention may be better understood with reference to the drawings and discussions that follow.

While the invention has been described with respect to a limited number of embodiments, those skilled in the art, having benefit of this disclosure, will appreciate that other embodiments can be devised which do not depart from the scope of the invention as disclosed herein.

The term "bevel gear" shall be defined as gears with teeth that meet at an angle to the axis of the gear. For example, bevel gears are essentially conically shaped, although the actual gear does not extend all the way to the vertex (tip) of the cone that bounds it. With two bevel gears in mesh, the vertices of their two cones lie on a single point, and the shaft axes also intersect at that point. The angle between the shafts can be anything except zero or 180 degrees.

The term "spiral bevel gear" shall be defined as gears in which the teeth of a bevel gear not straight-cut as with regular gears (also called spur gears) but, rather, are cut at an angle.

The term "miter gears" shall be defined as bevel and spiral bevel gears that meet at right or 90 degree angles.

Other types of gears are known in the art. The present invention is not limited by the types of gears, if any, that are used in the present invention.

The term "reduction gearing" shall be defined as gearing where the rotational speed of the first gear is faster than the rotational speed of the second gear as determined by the number of gear teeth on the two gears. For example, if the first gear is smaller than the second gear it will have fewer gear teeth than the second gear. Therefore, it will take the first gear a greater number of complete rotations to cause the second gear to rotate completely one time. The number of turns of the first gear required to turn the second gear one complete turn is known as the gear ratio. Thus, a reduction gear ratio of, for example, 4:1 will require the first (smaller) gear to rotate 4 time for each turn of the second (larger) gear.

The term "step-up gearing" shall be defined as gearing where the rotational speed of the first gear is slower than the rotational speed of the second gear as determined by the number of gear teeth on the two gears. For example, if the first gear is larger than the second gear it will have a greater number of gear teeth than the second gear. Therefore, it will take the first gear fewer complete rotations to cause the second gear to rotate completely one time. The number of turns of the first gear required to turn the second gear one complete turn is known as the gear ratio. Thus, a step-up gear ratio of, for example, 1:4 will require the first (larger) gear to rotate ¼ of a complete rotation time for each turn of the second (smaller) gear.

The term "linear spacing" shall be defined as the distance (or spacing) between two objects along a substantially straight line. The term or "linear location" shall be defined as the location of two objects with respect to each other along a substantially straight line. These terms (and similar terms known in the art) are essentially two different ways of defining the positioning of objects with regards to each other.

The term "circumferential spacing" shall be defined as the distance between two objects along the inside (or outside) curve of a circle. The term "circumferential location" shall be defined as the location of two objects with respect to each other along the inside (or outside) curve of a circle. These terms (and similar terms known in the art) are essentially two different ways of defining the positioning of objects with regards to each other.

The term "small water craft" shall be defined as a canoe, boat, kayak or other water vehicle that measures less than about 50 feet long, preferably less than about 35 feet long and more preferably less than about 20 feet long.

The term "viewed in toto" shall be defined as meaning viewing associated objects complete and together and not as the individual parts.

FIG. 1 shows one embodiment of the propulsion system of the present invention wherein a cut-a-way view of the drive mechanism of the present invention is visible. The power source is located in motor housing 10. The motor may be gas, electric or diesel, for example. The drive shaft 14 comprises a slip clutch 12 that allows for the motor to keep turning (i.e., the motor will not stall, over heat or burn-up) if the impeller mechanism stops due to debris or other reasons. The drive shaft ends in a gear 16 (for example, a conical gear or bevel or spiral bevel gear). The gear 16 meshes (interconnects) with a ring gear 20 that is fastened around the periphery of the impeller assembly 24. Thus, when the motor turns the drive shaft, the power is transferred to the ring gear 20 and causes the impeller assembly to rotate. The impeller assembly is mounted on sealed bearings 22. The purpose of the sealed bearing is two-fold. One, they allow the impeller assembly to rotate freely and two, they seal the interior cavity of the impeller housing 18 to prevent it from filling with water. Representations of the blades of the impeller assembly can be seen 26.

Figure 2:
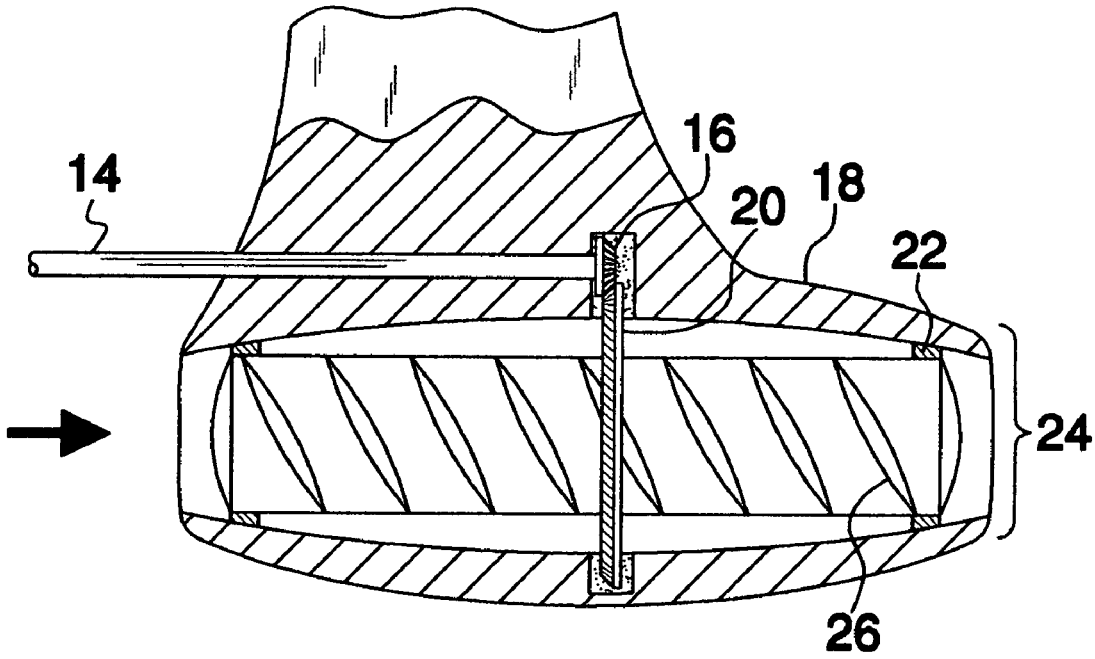
FIG. 2 shows a second embodiment of the propulsion system for watercraft of the present invention.

FIG. 2 shows one embodiment of the propulsion system of the present invention wherein the drive shaft is horizontal to the water and, for example, is powered by an inboard motor.

Figure 3B:
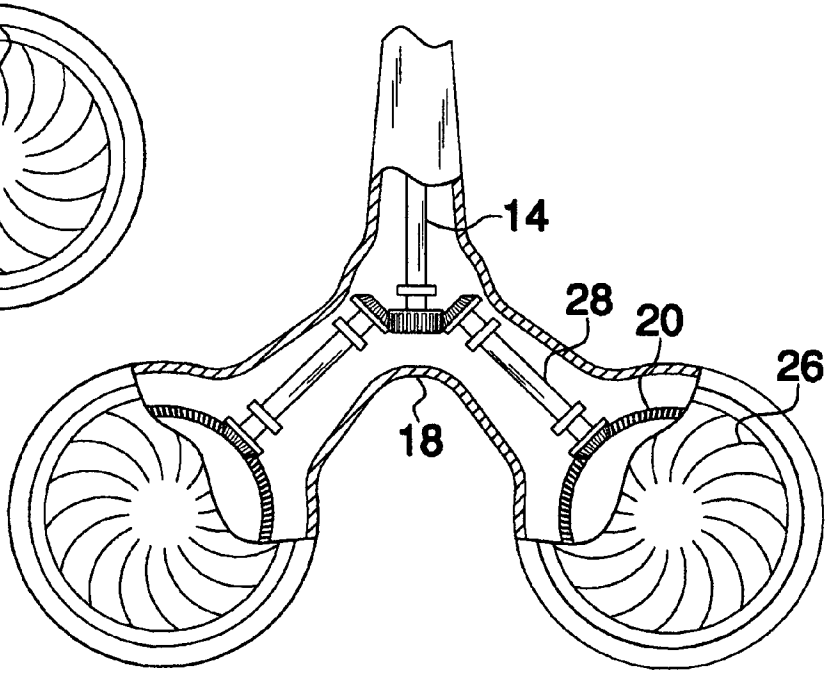
FIG. 3B shows a cut-a-way view of one embodiment of a dual impeller system of the present invention.
Figure 3A:
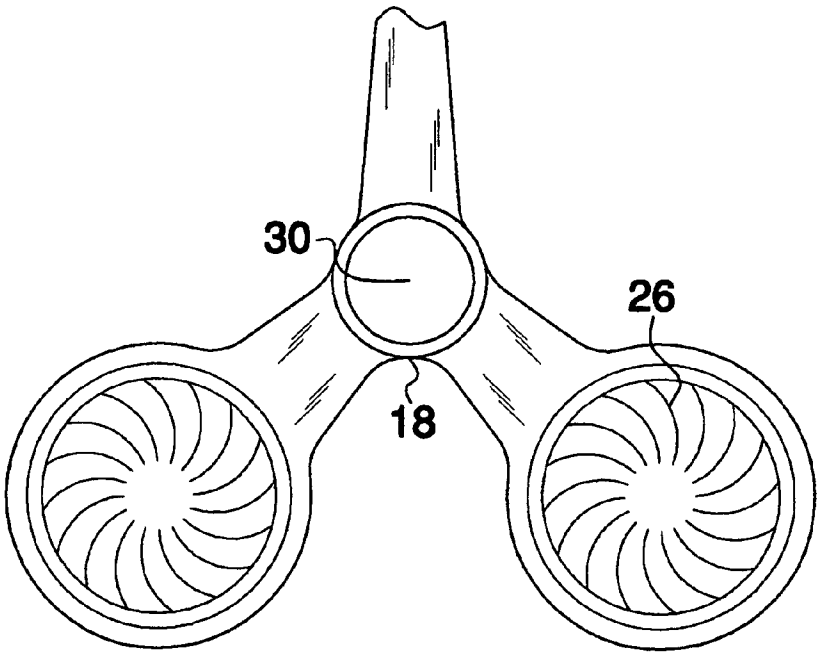
FIG. 3A shows an external view of one embodiment of a dual impeller system of the present invention.

FIGS. 3A and 3B show one embodiment of the present invention wherein the propulsion system of the present invention comprises two impeller assemblies. One advantage of this embodiment of the present invention is that if one impeller assembly 26 should break, become damaged or get clogged with debris, the other assembly can still power the watercraft. In this regard, each impeller assembly would be powered by a secondary drive shaft 28 that interconnects with the primary drive shaft 14. Furthermore, each secondary drive shaft would have an independent slip clutch mechanism thereby allowing each impeller assembly to turn freely of the other assembly if need be.

FIG. 3A shows an external view of this embodiment of the present invention. The impeller housing 18, impeller blades 26 and service access cover 30 can be scene in this view.

FIG. 3B shows a cut-a-way view of this embodiment of the present invention. In this view the drive shaft (primary drive shaft) 14 interconnects (meshes) with secondary drive shafts 28. The secondary drive shafts, in turn, mesh with ring gears 20. Slip clutches (not shown) are located on the secondary drive shafts. In another embodiment, a slip clutch may be located on the primary drive shaft in addition to or in place of the slip clutched located on the secondary drive shafts.

Figure 4A:
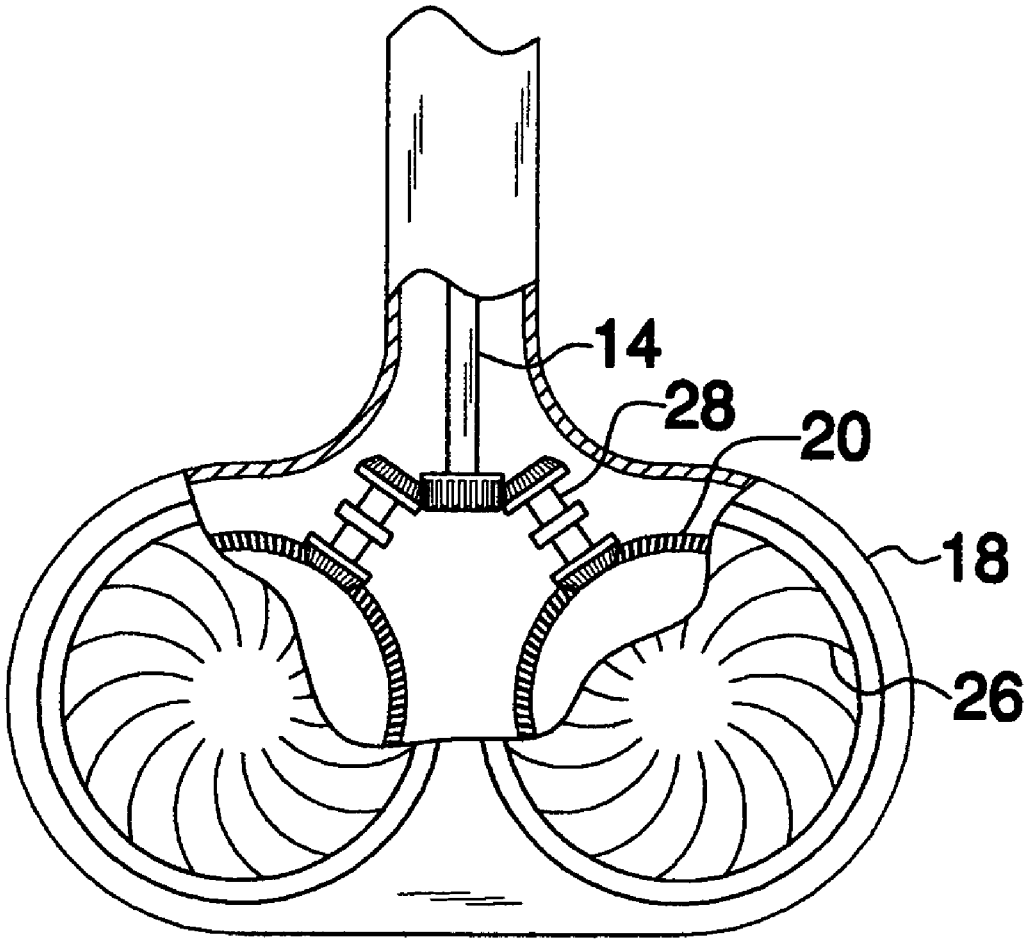
FIG. 4A shows a cut-a-way view of another embodiment of a dual impeller system of the present invention wherein the power from the drive shaft is directed to two secondary drive shafts before being transferred to the turbo impellers.
Figure 4B:
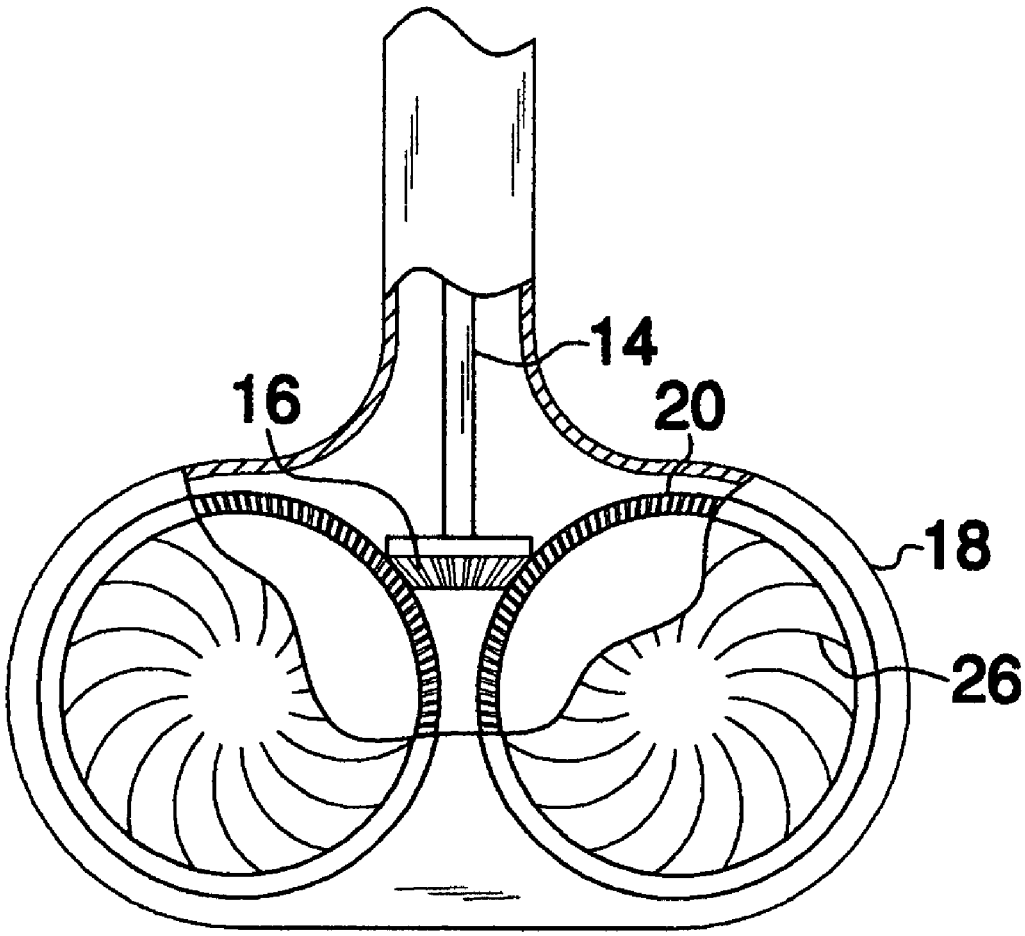
FIG. 4B shows a cut-a-way view of another embodiment of a dual impeller system of the present invention where the power from the drive shaft is transferred directly to the turbo impellers. In this embodiment, the blades in the turbo impellers would be oriented in opposite directions such that even thought they would spin in opposite directions, the water would be forced through the impellers in the same direction.
Figure 5:
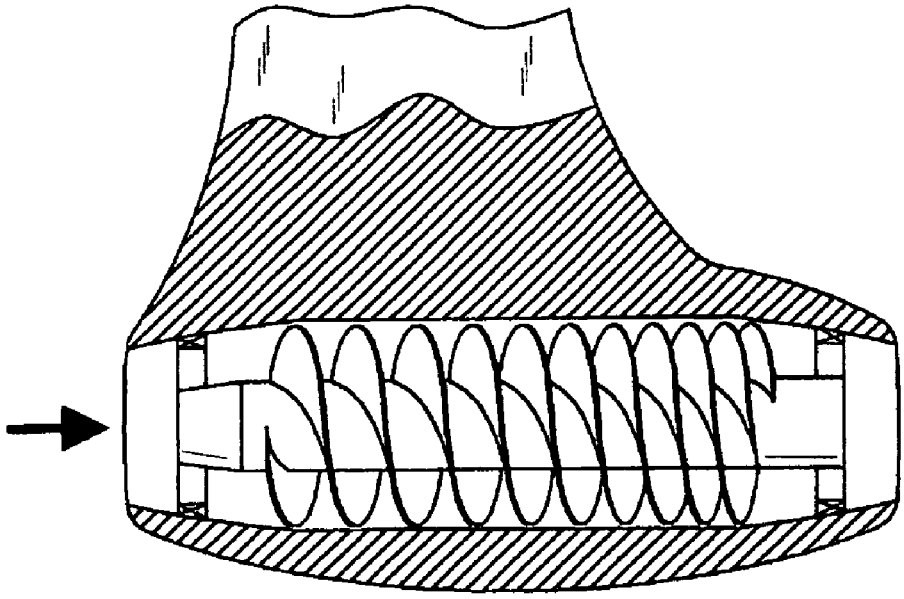
FIG. 5 shows a cut-a-way view of another embodiment the impeller system of the present invention wherein the impeller blade is a spiral blade extending from approximately the inlet to approximately the outlet of the tubular body wherein the distance between adjourning turns of the blade of the spiral are progressively closer to each other thereby creating a tighter spiral as the blade progresses from said inlet to said outlet thus resulting in a narrower passage for water.
Figure 6:
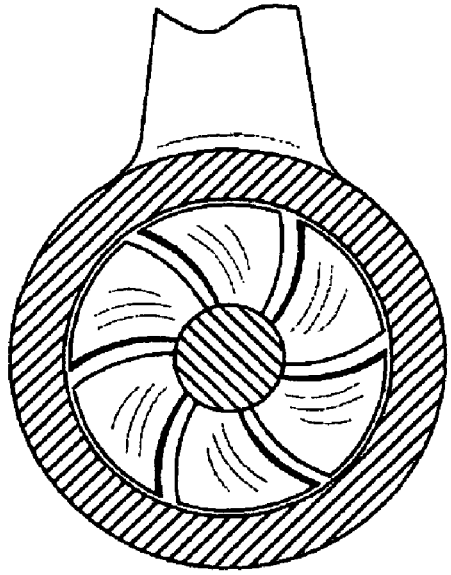
FIG. 6 shows an end view of one embodiment of the impeller system of the present invention wherein the circumferential location of said blades staggered such that their locations within said impeller body, when viewed in toto, approximate a spiral comprising a plurality of individual.

FIGS. 4A and 4B show another embodiment of the present invention wherein the propulsion system of the present invention comprises two impeller assemblies.

FIG. 4A shows a cut-a-way view of this embodiment of the present invention. In this view the drive shaft (primary drive shaft) 14 interconnects (meshes) with secondary drive shafts 28. The secondary drive shafts, in turn, mesh with ring gears 20. Slip clutches (not shown) are located on the secondary drive shafts. In another embodiment, a slip clutch may be located on the primary drive shaft in addition to or in place of the slip clutched located on the secondary drive shafts.

FIG. 4B shows a cut-a-way view of this embodiment of the present invention. In this view the drive shaft (primary drive shaft) 14 interconnects (meshes) directly with the ring gears 20. The slip clutch (not shown) is located the primary drive as shown in FIG. 1.

What is claimed is:

1. A propulsion system for a small water craft, comprising:

a. a housing having an interior space for receiving an impeller, said impeller comprising a tubular body and two or more groups of blades, each group of blades comprising a plurality of blades extending from the inside of said tubular body towards the center of said tubular body without meeting at the center of said tubular body and angled to push water from the inlet to the outlet of the impeller housing when said impeller is powered to rotate;

b. the linear spacing of said blades along the axis of said impeller body being progressively closer each other as the blades approach the impeller outlet and the circumferential location of said blades staggered such that their locations within said impeller body, when viewed in toto, approximate a spiral comprising a plurality of individual blades, said spiral getting progressively tighter towards the outlet;

c. said impeller body supported on sealed bearings thereby allowing the impeller to rotate in said housing while preventing water from entering said housing;

d. said impeller powered by a ring gear, said ring gear attached to the exterior of said impeller body; said ring gear driven by a drive shaft, said drive shaft comprising first and second ends, said first end comprising a bevel or spiral bevel gear that intermeshes with said ring gear and said second end comprising a slip clutch, wherein said slip clutch is connected to a power source when said power source is turned on and the rotation of said impeller is not impeded and is not connected to said power source when the rotation of said impeller is impeded.

2. The impeller of claim 1, wherein said distance between spirals decreases by about 0.1-0.5% with every turn.

3. The impeller of claim 1, wherein said distance between spirals decreases by about 0.5-3.0% with every turn.

4. The impeller of claim 1, wherein said slip clutch is designed to slip at 10 pounds of torque or greater.

5. The impeller of claim 1, wherein said slip clutch is designed to slip at 20-30 pounds of torque or greater.

6. The impeller of claim 1, wherein said impeller is made of a material selected from a group consisting of any one or more of metal, plastic, hardened rubber, graphite or carbon fiber.

7. The drive shaft of claim 1, wherein said drive shaft additionally comprises reduction gearing or step-up gearing.

8. The propulsion system of claim 1, wherein said system comprises two impeller housings, each impeller housing having an impeller, both impellers driven by the same drive shaft.

9. The propulsion system of claim 1, wherein said system comprises two impeller housings, each impeller housing having an impeller, both impellers driven by different secondary drive shafts, each secondary drive shaft powered by the same power source through a primary drive shaft.

10. The propulsion system of claim 9, wherein each impeller and driveshaft combination has a separate slip clutch.

11. A propulsion system for a small water craft, comprising:

a. an impeller housing having an interior space for receiving an impeller, said impeller comprising a tubular body having an inlet and an outlet, a spiral blade extending from approximately the inlet to approximately the outlet of the tubular body wherein the distance between adjourning turns of the blade of the spiral are progressively closer to each other thereby creating a tighter spiral as the blade progresses from said inlet to said outlet thus resulting in a narrower passage for water;

b. said impeller body supported on sealed bearings thereby allowing the impeller to rotate in said housing while preventing water from entering said housing;

c. said impeller powered by a ring gear, said ring gear attached to the exterior of said impeller body; said ring gear driven by a drive shaft, said drive shaft comprising first and second ends, said first end comprising a bevel or spiral bevel gear that intermeshes with said ring gear and said second end comprising a slip clutch, wherein said slip clutch is connected to a power source when said power source is turned on and the rotation of said impeller is not impeded and is not connected to said power source when the power source is turned on and the rotation of said impeller is impeded.

12. The impeller of claim 11, wherein said distance between spirals decreases by about 0.1-0.5% with every turn.

13. The impeller of claim 11, wherein said distance between spirals decreases by about 0.5-3.0% with every turn.

14. The impeller of claim 11, wherein said slip clutch is designed to slip at 10 pounds of torque or greater.

15. The impeller of claim 11, wherein said slip clutch is designed to slip at 20-30 pounds of torque or greater.

16. The impeller of claim 11, wherein said impeller is made of a material selected from a group consisting of any one or more of metal, plastic, hardened rubber, graphite or carbon fiber.

17. The drive shaft of claim 11, wherein said drive shaft additionally comprises reduction gearing or step-up gearing.

18. The propulsion system of claim 11, wherein said system comprises two impeller housings, each impeller housing having an impeller, both impellers driven by the same drive shaft.

19. The propulsion system of claim 11, wherein said system comprises two impeller housings, each impeller housing having an impeller, both impellers driven by different secondary drive shafts, each secondary drive shaft powered by the same power source through a primary drive shaft.

20. The propulsion system of claim 19, wherein each impeller and driveshaft combination has a separate slip clutch.

* * * * *